US005146856A

United States Patent [19]

George

[11] Patent Number: 5,146,856

[45] Date of Patent: Sep. 15, 1992

[54] POWER PLAN WITH A SCREW CONVEYOR ASH COOLER

[75] Inventor: Bengt-Göran George, Enköping, Sweden

[73] Assignee: ABB Stal Ab, Finspong, Sweden

[21] Appl. No.: 634,134

[22] Filed: Mar. 21, 1991

[30] Foreign Application Priority Data

Jul. 6, 1988 [SE] Sweden ..... 8802526-7

[51] Int. Cl.[5] ..... F23J 1/02

[52] U.S. Cl. ..... 110/171; 110/165 R; 110/233; 110/259; 122/4 D

[58] Field of Search ..... 110/171, 165 R, 259, 110/110, 233; 122/4 D

[56] References Cited

U.S. PATENT DOCUMENTS

| | | | |
|---|---|---|---|
| 1,303,470 | 5/1919 | Gillette . | |
| 4,009,667 | 3/1977 | Tyer et al. . | |
| 4,267,801 | 5/1981 | Robinson | 122/4 D |
| 4,738,687 | 4/1988 | Smieskol et al. | 110/171 X |
| 4,872,423 | 10/1989 | Pillai | 122/4 D |
| 4,901,652 | 2/1990 | Pressnall et al. | 110/259 |
| 4,909,028 | 3/1990 | Cetrelli et al. | 122/4 D X |
| 4,961,389 | 10/1990 | Pillsbury | 110/171 X |

FOREIGN PATENT DOCUMENTS 8404955 12/1984 World Int. Prop. O. .

*Primary Examiner*—Edward G. Favors

*Attorney, Agent, or Firm*—Pollock Vande Sande & Priddy

[57] ABSTRACT

In a power plant, for example of PFBC type, with a cooler for cooling of ashes originating in a fluidized bed, the cooler comprises a cylinder with a transport screw which transports the ashes through the cylinder. The transport screw has a tubular shaft which is transversed by cooling water. The cylinder may be air or water-cooled. At the bottom of the cylinder one or more fluidization devices are provided, which maintain the ashes in the cylinder in fluidized condition, so as to obtain good contact and effective heat transfer to cooling surfaces of the shaft and the cylinder. The fluidization also reduces the propensity of the ash to form a heat-insulating layer on the inside of the cylinder which reduces the cooling capacity.

10 Claims, 4 Drawing Sheets

FIG. 5A
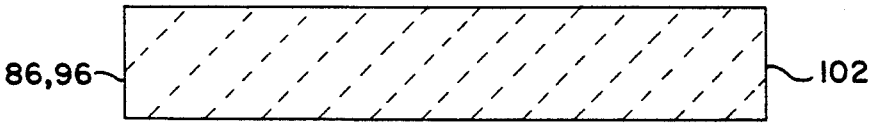
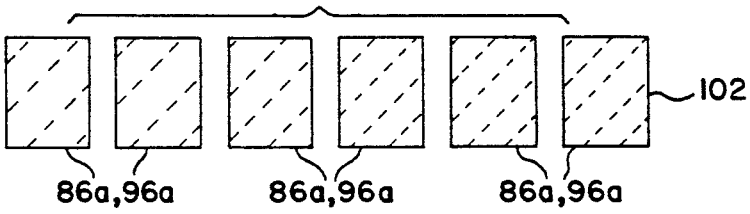
FIG. 5B
FIG. 6A
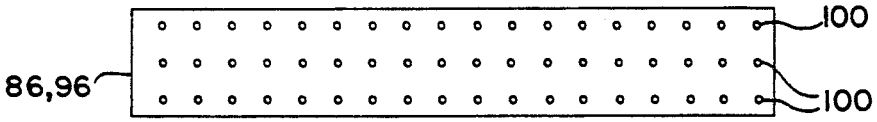
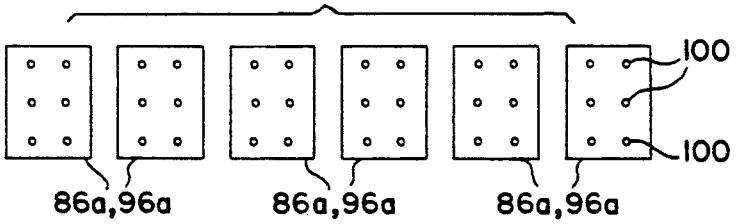
FIG. 6B
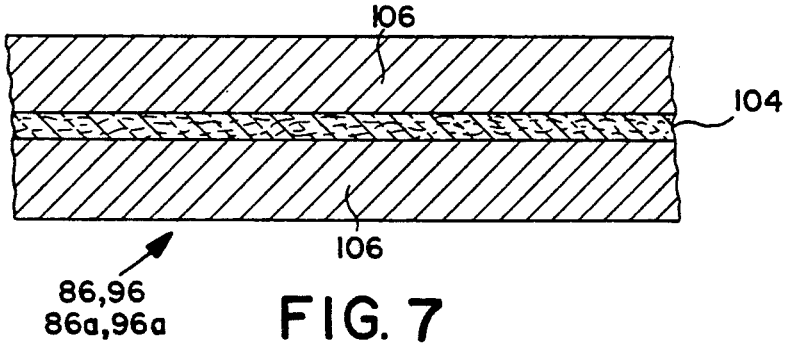
FIG. 7

POWER PLAN WITH A SCREW CONVEYOR ASH COOLER

TECHNICAL FIELD

The invention relates to a power plant, preferably a PFBC power plant, with an ash cooler comprising an air- or water-cooled cylinder and a water-cooled rotor with a screw. Ashes or other residual products from the plant are cooled while being transported through the cylinder with the aid of the screw.

The term PFBC is formed by the initial letters in Pressurized Fluidized Bed Combustion.

BACKGROUND ART

Screw-type coolers for cooling hot particulate material, for example ashes from combustion plants with a cooled mantle and a cooled feed gear, are already known. For cooling of fine-grained ashes separated from flue gases in PFBC power plants, it has been found that prior art coolers of this kind do not provide satisfactory cooling. The material between two threads of the screw is transported axially in the cylinder without any mentionable mixing. A good contact and effective cooling between the powder mass is obtained only on the driving side of the screw. The screw cools the inner part of the powder mass only insignificantly. The cooling is ineffective. The material also has a tendency to form a layer with great heat transfer resistance on the inner side which makes up the major part of the cooling surface of the cooler. Only material that is brought into direct contact with the water-cooled rotor is effectively cooled. The cooling capacity is therefore reduced to such a considerable extent that satisfactory cooling in equipment with moderate dimensions is not obtained. A doubling or enlargement of a cooler entails increased space and higher construction costs.

SUMMARY OF THE INVENTION

According to the present invention, the lower part of the cylinder is provided with a fluidization device. This may extend along the major part of the length of the cylinder or consist of a plurality of different parts or sections which may be placed at some distance from each other. The fluidization device comprises a gas-permeable bottom through which fluidizing gas is distributed evenly over the surface of the fluidization device. It must be designed so as to prevent fine-grained ashes from passing down through this bottom. In view of the fact that the ashes from a PFBC power plant may have a high temperature, the gas-permeable bottom must be heat-resistant. It may include nozzles but suitably consists of porous metal or ceramic discs, for example of the type used for filters, but also woven glass fibre may be used. When woven glass fibre is used it may be placed between perforated discs or between reinforcing metal nets.

When fluidizing the material in the cooler, the advantage is gained that the material behaves almost as a liquid, is mixed and brought into contact with the cooled shaft of the screw. The fluidization also considerably increases the coeffient of heat transfer A, which also to a considerable extent contributes to an increase in the cooling capacity of the shaft. In addition, the fluidization results in some reduction of the propensity of the material to form an insulating layer on the inner side of the cylinder, which largely improves the cooling capacity of the cooler. Also, the fluidization reduces the wear.

BRIEF DESCRIPTION OF THE DRAWING

The invention will be described in greater detail with reference to the accompanying drawings, showing the invention applied to a PFBC power plant, where:

FIG. 5A shows a top view of one embodiment of a gas-permeable bottom;

FIG. 5B shows a gas-permeable bottom of FIG. 5A divided into sections;

FIG. 6A shows a top view of another embodiment of a gas-permeable bottom;

FIG. 6B shows a gas-permeable bottom of FIG. 6A divided into section; and FIG. 7 shows a cross section through an embodiment of a gas-permeable bottom made of glass fiber.

DESCRIPTION OF THE PREFERRED EMBODIMENT

Figure 1:
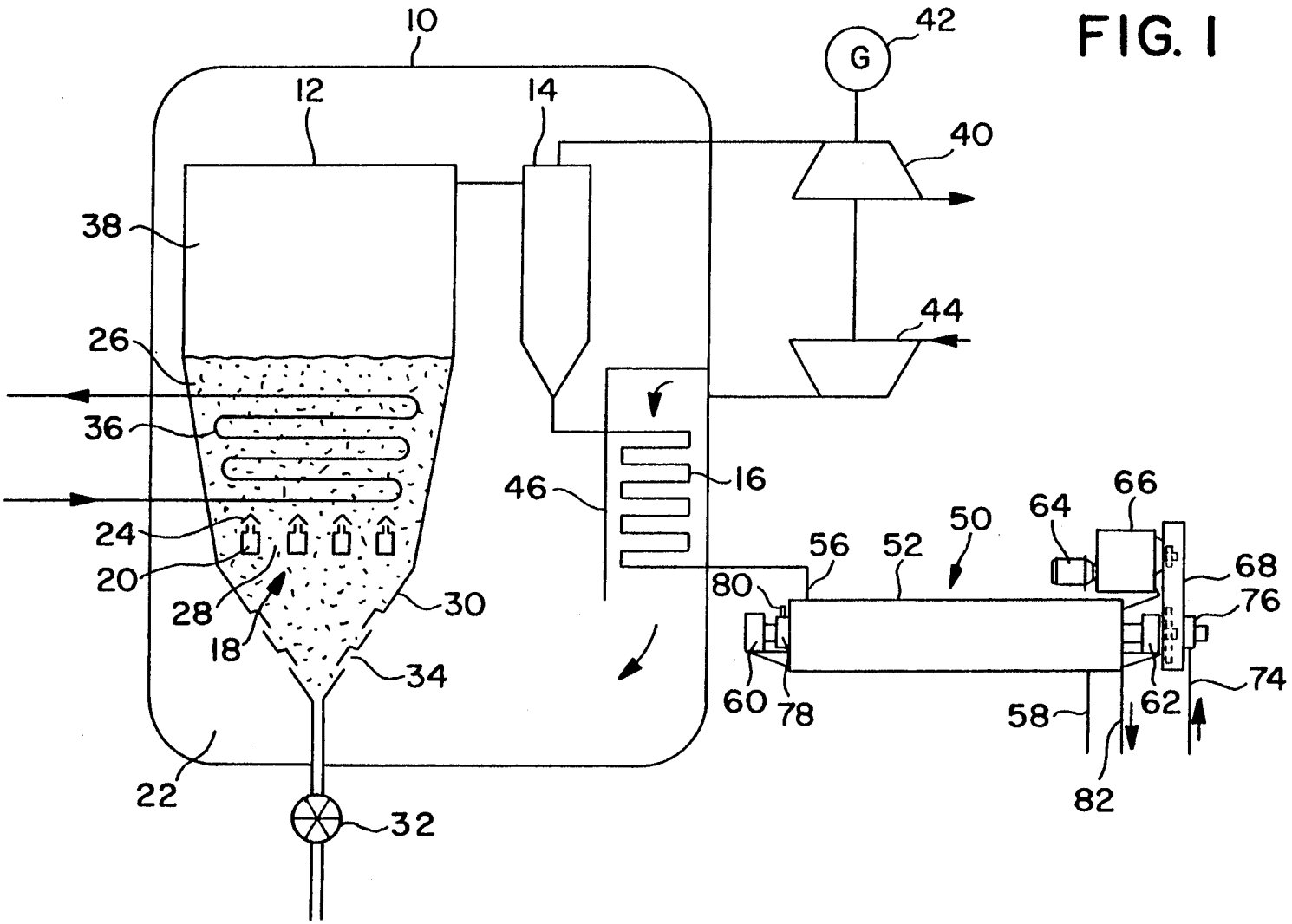
FIG. 1 shows schematically a power plant with a screw conveyor ash cooler.
Figure 2:
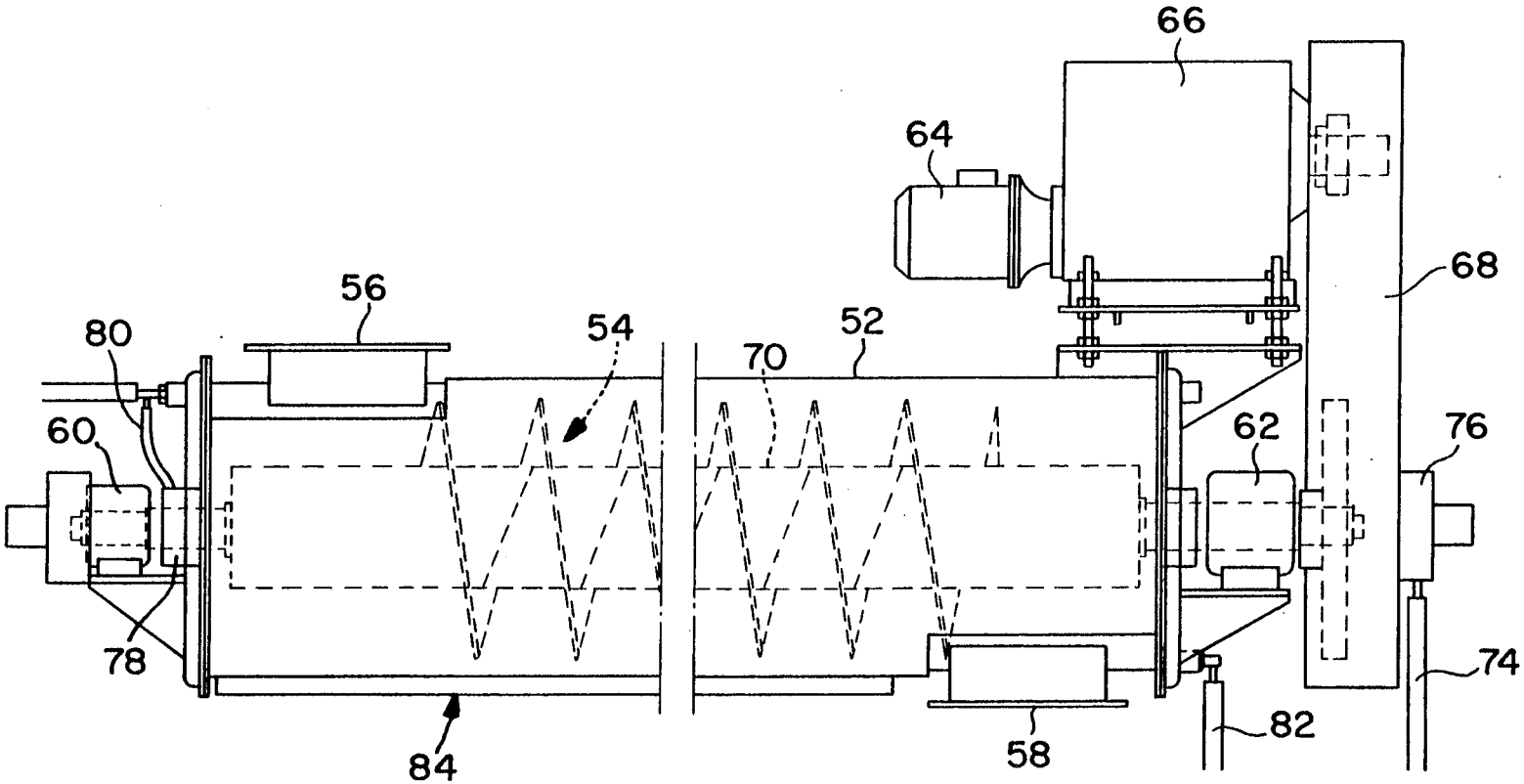
FIG. 2 shows a side view and a longitudinal section of FIG. 1.

In the figures, 10 designates a pressure vessel. In the vessel in there are placed a combustor 12, a cleaning plant 14, symbolized by a cyclone, and a pressure-reducing ash discharge device 16. The combustor 12 has an air-distributing bottom 18 consisting of air-distributing tubes 20 communicating with the space 22 in the pressure vessel 10. Through the nozzles 24 the combustor 12 is supplied with air for fluidizing the bed 26 and combustion of a fuel. Between the air-distributing tubes 20 there are gaps 28 through which bed material is able to pass to the ash chamber 30. Air for cooling the material before it is withdrawn via the discharge device 32, is supplied to the chamber 30 via openings 34. The combustor 12 includes tubes 36 for cooling the bed 26 and generating steam. Combustion gases are collected in the freeboard 38, are cleaned in the cyclone 14, and are passed to the turbine 40. This drives the generator 42 and the compressor 44 which supplies the plant with compressed combustion air. Air is supplied to the space 22 via the duct 46. The ash discharge device 16 is placed in this duct and forms a cooler which is cooled by the combustion air flowing in. Ashes separated in the cyclone 14 are cooled in the ash discharge device 16 from about 850° C. to about 400° C.

From the pressure-reducing ash discharge device 16 the ashes are passed to the ash cooler 50 located outside the pressure vessel 10. The ash cooler comprises a cylinder 52 with a screw 54 feeding ashes from the inlet 56 to the outlet 58. The screw 54 is journalled on bearings 60 and 62 at the ends of the cylinder 52 and is driven by a motor 64 via the gear 66 and the power transmission 68.

Figure 3:
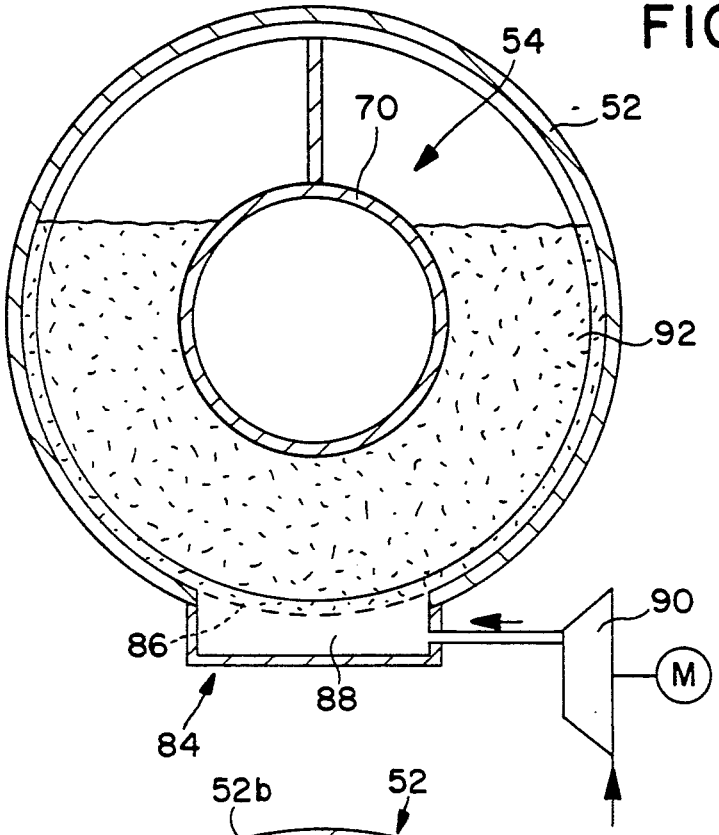
FIGS. 3 and 4 are cross sections through a cooler with different designs of the fluidization device and with an air-cooled and a water-cooled cylinder, respectively.
Figure 4:
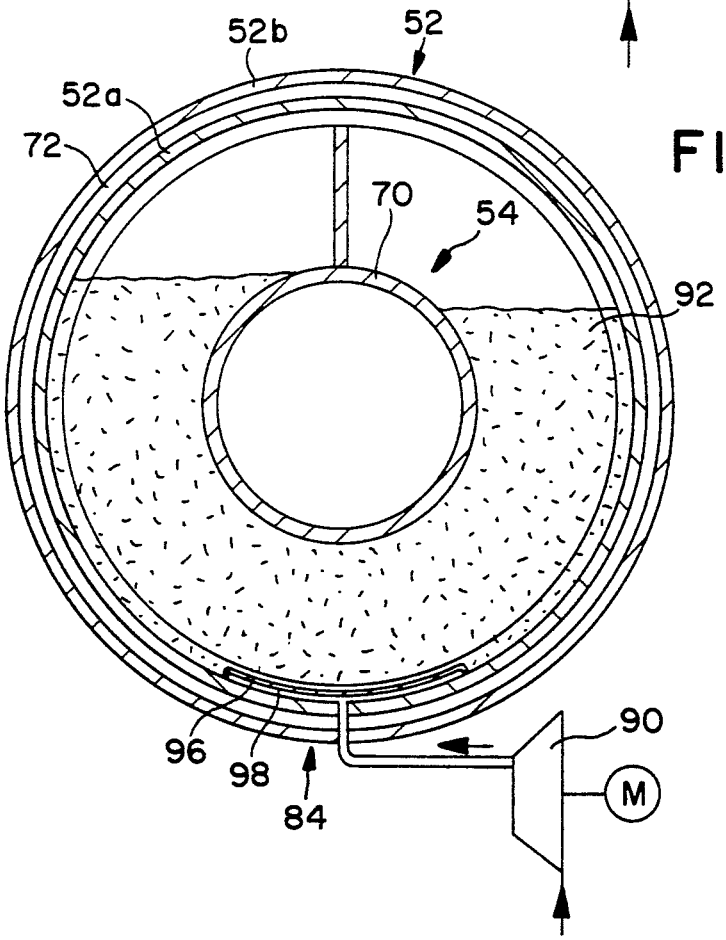

The shaft 70 of the screw 54 is tubular and water-cooled. The cylinder 52 may be air-cooled, as shown in FIG. 3, or water-cooled, as shown in FIG. 4. In the latter embodiment, the cylinder 52 comprises an inner cylinder **52*a* and an outer cylinder 52*b* forming a gap 72 for cooling water. In the embodiment with a water-cooled cylinder 52, cooling water is introduced into shaft 70 via the conduit 74 and the swivel 76, is transmitted from the shaft 70 to the gap 72 of the cylinder 52 via the swivel 78 and the conduit 80, and is discharged from the cylinder 52 through the conduit 82**.

The lower part of the cylinder 52 is provided with a fluidization device 84. In the embodiment according to FIG. 3, the cylinder 52 is provided with one or more openings with an air-distributing bottom 86, 86*a* and one or more air-distributing chambers 88 which are supplied with air from the compressor 90 for fluidization of ashes 92 present in the cylinder 52.

In the embodiment according to FIG. 4, the fluidization device 84 comprises an air-distributing bottom 96 or a number of mutually spaced-apart bottom segments 96*a*, below which an air-distributing space 98 is provided which is supplied with air from the compressor 90 for fluidization of the ashes 92.

The air distributing bottom amy in clude nozzles 100 (FIGS. 6A, 6B) but suitably consists of porous metal or ceramic discs 102 (FIGS. 5A, 5B), for example of the type used for filters, but also woven glass fibre 104 may be used (FIG. 7). When woven glass fibre 104 is used it may be placed between perforated discs or reinforcing metal nets 106.

I claim:

1. In a power plant, preferably of PFBC type, with a cooler for ashes originating in a bed, said cooler comprising an elongated, substantially horizontal cylinder or tray with a screw having a water-cooled shaft which transports the ashes through the cylinder and cools the ashes the lower part of the cylinder or tray of the cooler being provided with a fluidization device which includes a gas-permeable bottom and devices for supplying this bottom with a gas fluidization of ashes present in the cylinder.

2. A plant according to claim 1, wherein the gas-permeable bottom extends at least along the major part of the entire length of the cylinder.

3. A plant according to claim 1, wherein the gas-permeable bottom is divided into a plurality of sections.

4. A plant according to claim 3, wherein said sections are arranged at a certain distance from one another.

5. A Plant according to claim 1, wherein the gas-permeable bottom contains a number of nozzles.

6.. A plant according to claim 1, wherein the gas-permeable bottom consists of a porous metal or ceramic disc.

7. A plant according to claim 1, wherein the gas-permeable bottom comprises a fabric such as fiberglass and support means therefor in the form of nets or perforated plates.

8. A plant according to claim 4, wherein the gas-permeable bottom contains a number of nozzles.

9. A plant according to claim 4, wherein the gas-permeable bottom consists of a porous metal or ceramic disc.

10. A plant according to claim 4, wherein the gas-permeable bottom comprises a fabric such as fiberglass and support means therefor in the form of nets or perforated plates.

* * * * *